US006474467B1

(12) United States Patent
Kurdian

(10) Patent No.: US 6,474,467 B1
(45) Date of Patent: Nov. 5, 2002

(54) LUMINESCING BOTTLE

(76) Inventor: Varant Kurdian, 1411 Brand Blvd., Unit #1, Glendale, CA (US) 91202

( * ) Notice: Subject to any disclaimer, the term of this patent is extended or adjusted under 35 U.S.C. 154(b) by 0 days.

(21) Appl. No.: 09/948,844

(22) Filed: Sep. 7, 2001

(51) Int. Cl.[7] ..... F21V 8/00; B65D 77/00

(52) U.S. Cl. ..... 206/222; 206/219; 206/459.5; 362/34; 220/506; 220/592.28

(58) Field of Search ..... 206/219, 222, 206/459.5; 362/34; 220/506, 592.28

(56) References Cited

U.S. PATENT DOCUMENTS 5,171,081 A * 12/1992 Pita et al. ..... 362/34
5,769,680 A * 6/1998 Hoffman ..... 206/217
5,797,669 A * 8/1998 Fujita ..... 362/34
5,881,868 A * 3/1999 Soyak et al. ..... 200/217
6,062,380 A * 5/2000 Dorney ..... 362/34
6,082,866 A * 7/2000 Amedee ..... 362/34

* cited by examiner

*Primary Examiner*—Joseph M. Moy
(74) *Attorney, Agent, or Firm*—James E. Brunton

(57) ABSTRACT

A sealable plastic bottle that can be relatively effortlessly manipulated at anytime and any place to cause a pleasing and highly colorful chemiluminescent reaction to occur. The bottle can be securely sealed and can be used to carry drinking water or soft drinks and one that can conveniently be used at the same places for the same activities and at the same times as conventional plastic water bottles and like sealed drink containers. Additionally, the bottle includes a removable closure cap and is uniquely constructed so as to provide secure containment of chemiluminescent fluids between the inner and outer walls of the bottle construction.

10 Claims, 2 Drawing Sheets

LUMINESCING BOTTLE

BACKGROUND OF THE INVENTION

1. Field of the Invention

The present invention relates generally to plastic bottles. More particularly, the invention concerns a luminescent plastic bottle of the type used to contain drinking water and soft drinks.

2. Discussion of the Prior Art

In recent years small, readily portable bottles containing drinking water and soft drinks have become extremely popular. Such bottles are routinely carried by travelers, joggers, bicyclists, hikers and other active people and range in size from approximately 8 fluid ounce bottles to larger approximately 70 fluid ounce bottles. Typically, the prior art plastic water bottles are generally cylindrical in shape having mildly compressible sidewalls.

The phenomenon known as chemiluminescense, which is defined as luminescence due to chemical reaction, is well known and chemiluminescent devices of various types have been developed in the past. By way of example, a common use of chemiluminescense is in the manufacture of emergency lighting devices. Such devices typically comprise a tubular member with a central partition dividing the tube into two compartments. Each compartment contains one of the chemiluminescent fluids so that when the partition is broken or displaced, the two chemicals can intermix to produce the chemiluminescent reaction.

Other prior art devices that make use of chemiluminescence including drinking vessels such as plastic cups and glasses that can be used in locations having subdued lighting conditions to produce novel and colorful lighting effects. Exemplary of such devices are those disclosed in U.S. Pat. No. 5,171,081 issued to Pita et al and in U.S. Pat. No. 6,062,380 issued to Dorney. The Pita et al device comprises a drinking vessel having inner and outer walls and floors with a space therebetween. A chemiluminescent fluid is disposed within at least the floor space. Another chemiluminescent fluid is contained separately within a toroidal tube in the upper or lower rim of the vessel. The vessel and tube are preferably formed of a flexible and translucent plastic. Thus, when the rim is flexed, the toroidal tube is compressed, causing the fluid contained therein to rupture a thin membrane separating the volumes of the tube and wall or floor space and allowing the fluid contained within the tube to flow into the space between the two walls and floors to mix with the other chemiluminescent fluid and thereby produce a glow from the vessel.

The Dorney apparatus comprises a chamber formed with an open top and a closed bottom and a sidewall between top and bottom. The sidewall has a cylindrical wall extending from a location adjacent to the top downwardly to a location adjacent to the bottom and radially exterior of the sidewall and with a circular member to form a seal at the bottom of the outer wall to totally close the space between the sidewall and the outer wall. An insert of a plastic material is located within the space with an inner surface in proximity to the outer surface of the sidewall. A recess is formed along one vertical extent and between the insert and a sidewall. A fracturable ampule is vertically oriented within the recess and contains a first chemiluminescent fluid. A second chemiluminescent fluid is positionable within the space and is adapted to be illuminated upon the fracturing of the ampule and contact with the first chemiluminescent fluid.

Unlike the Pita et al and Dorney devices, which are not readily portable and cannot be sealed, the novel bottle construction of the present invention can be securely closed and can conveniently be used in lieu of conventional water bottles by travelers, joggers, hikers, bicyclists and the like to create at any time and any place a novel and colorful effect by simply manipulating the bottle in a manner to cause the chemiluminescent reaction to occur.

SUMMARY OF THE INVENTION

It is an object of the present invention to provide a sealable plastic bottle of novel construction that can be relatively effortlessly manipulated at anytime and any place to cause a pleasing and highly colorful chemiluminescent reaction to occur.

Another object of the invention is provide a bottle of the aforementioned character that can be securely sealed and can be used to carry drinking water or soft drinks and one that can conveniently be used at the same places, for the same activities and at the same times as conventional plastic water bottles and like sealed drink containers.

Another object of the present invention is to provide an improved plastic bottle that includes a removable closure cap and is uniquely constructed so as to provide secure containment of chemiluminescent fluids between the inner and outer walls of the bottle construction.

Yet another object of the present invention is to provide a lightweight plastic bottle including means for reliable but frangible separation of the chemiluminescent fluids contained therein.

Still another object of the present invention is to provide a plastic bottle as described in the preceding paragraph that includes means for the destruction of a frangible separation membrane disposed between the chemiluminescent fluids.

A further object of the present invention is to provide a plastic bottle that includes translucent or transparent walls in order that any chemiluminescent reaction therein may be readily observed.

It is another object of the present invention to provide a new and improved plastic bottle that can be easily and efficiently manufactured and marketed.

It is a further object of the present invention to provide a plastic bottle of the class described that is of a durable and reliable construction.

DESCRIPTION OF THE INVENTION

Figure 1:
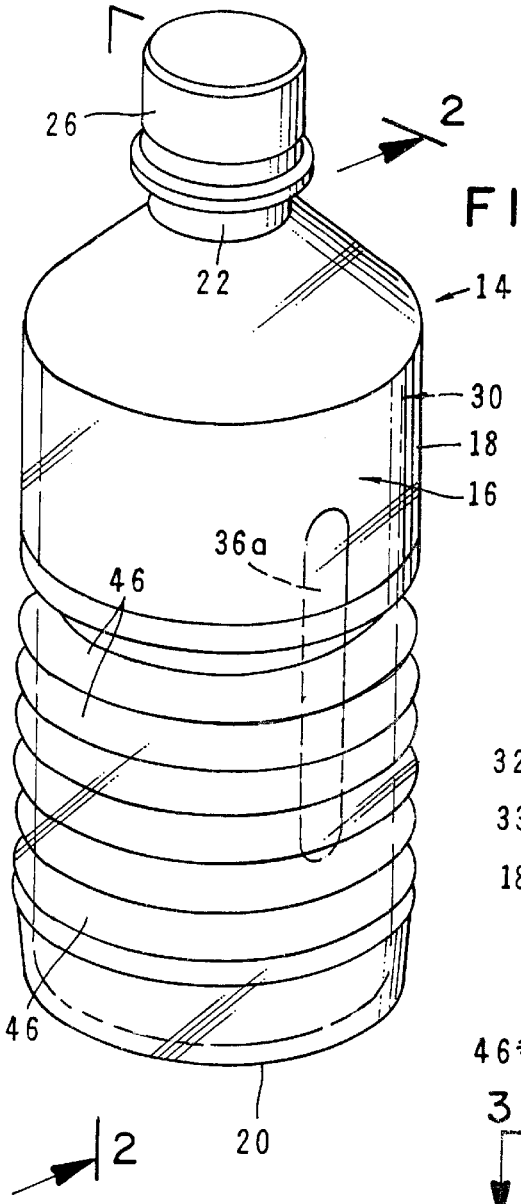
FIG. 1 is a generally perspective view of one form of the luminescing plastic bottle of the invention.

Referring to the drawings and particularly to FIG. 1, one form of the illuminenescent beverage containing device of the present invention is there illustrated and generally designated by the numeral 14. As best seen by referring to FIGS. 3 and 4, the container includes an outer body 16 having a yieldably deformable outer sidewall 18 and a bottom wall 20. Outer wall 18 terminates proximate its upper end at a neck 22 that defines an opening 24 for dispensing the beverage from the bottle. Connected to neck 22 is closure means shown here as a screw cap 26 for closing the opening 24.

Figure 2:
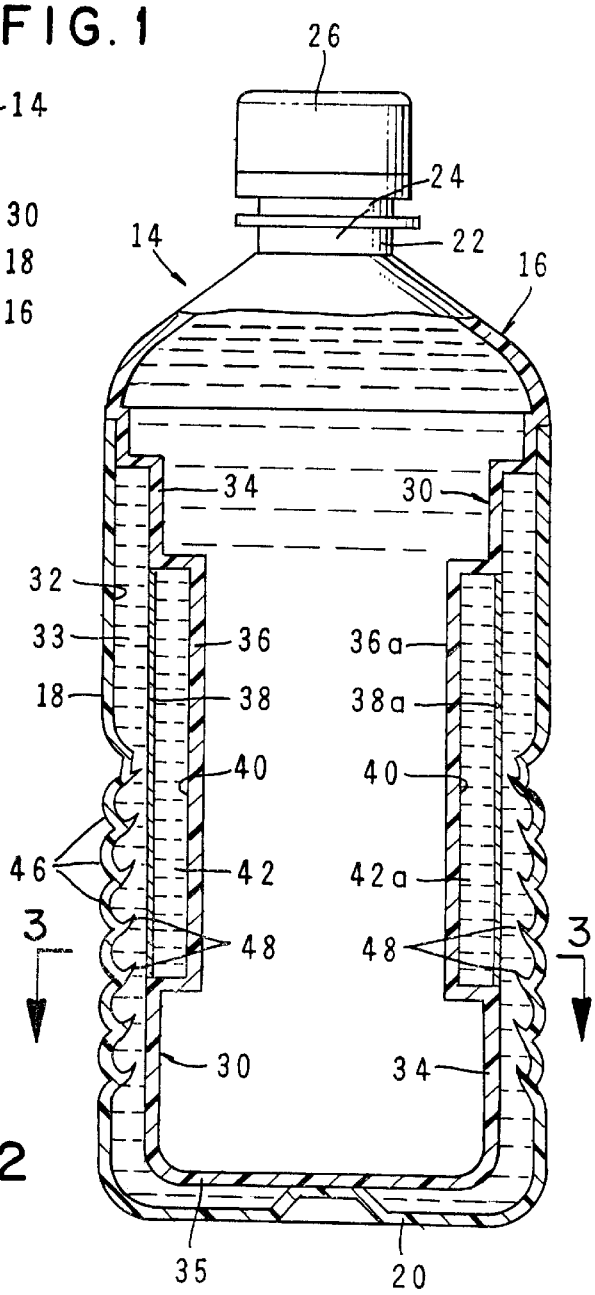
FIG. 2 is an enlarged cross-sectional view taken along lines 2—2 of FIG. 1.
Figure 3:
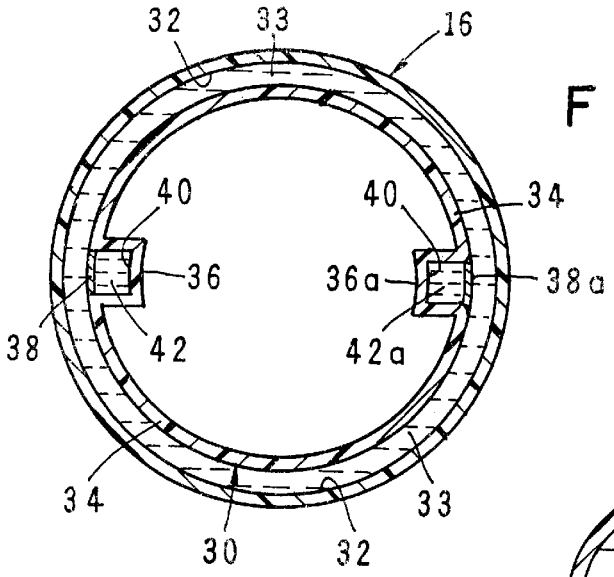
FIG. 3 is a cross-sectional view taken along lines 3—3 of FIG. 2.

Strategically positioned within outer body 16 is an inner body 30. Inner body 30 cooperates with wall 18 of the outer body to define a first space 32. In a manner presently to be described, a first chemiluminescent fluid 33 is disposed within space 32 (FIG. 2). Inner body 30 includes a sidewall 34 and a bottom wall 36 that has the configuration best seen in FIG. 4. Connected to inner wall 34 are first and second ampules 36 and 36*a* respectively. As illustrated in FIG. 3, each of the ampules 36 and 36*a* is closed by a frangible membrane 38 so as to form a second space or liquid receiving chamber 40. More particularly, as illustrated in FIG. 3, inner sidewall 34 of inner body 30 has a pair of shaped cavities that are co-extensive with fluid receiving 40. In a manner presently to be described, these fluid-containing chambers or second spaces 40 contain the second and third chemiluminescent fluids 42 and 42*a* (FIG. 2). Frangible wall 38 which forms the frangible closure means of the invention can be constructed of a thin frangible plastic membrane and functions to close chamber 40 so as to contain the second and third chemiluminescent fluids therewithin.

Figure 4:
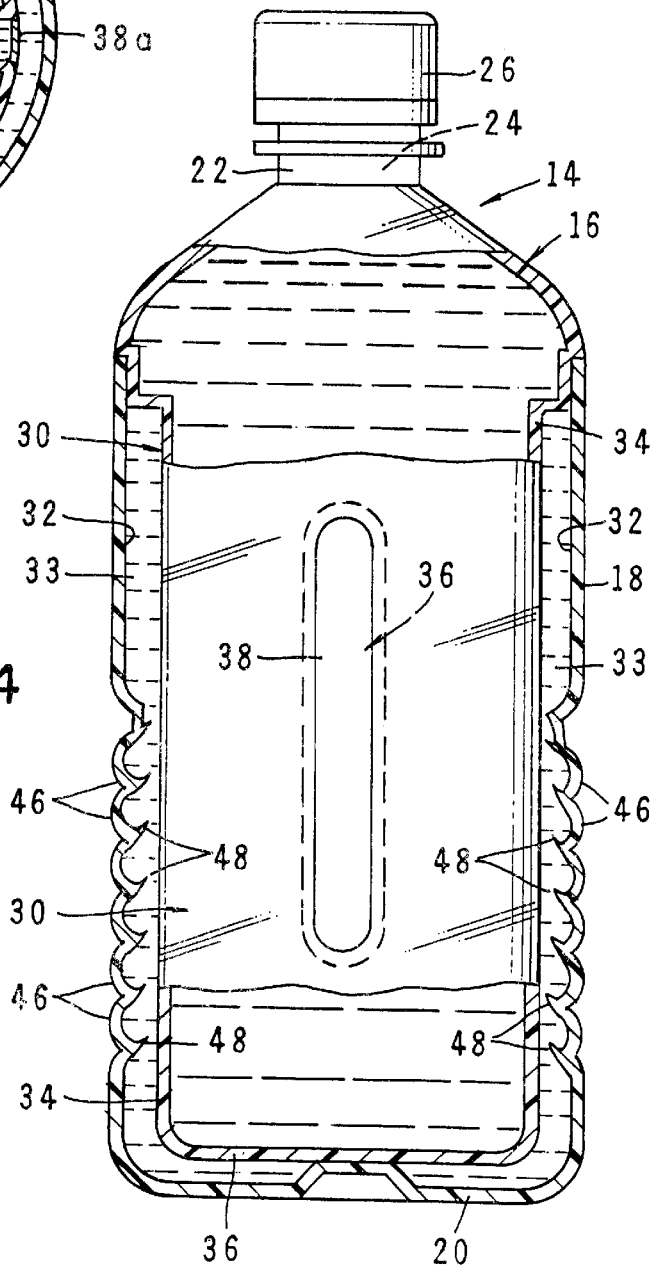
FIG. 4 is a side-elevational view of the bottle shown in FIG. 1 partly broken away to show internal construction.

Referring particularly to FIGS. 2 and 4, it is to be noted that the lower portion of outer body 16 is provided with a plurality of vertically spaced ribs 46. Uniquely, each of the ribs 46 is provided with a fluid deflector means shown here as a plurality of circumferentially extending rib-like deflector protuberances 48, the purpose of which will presently be described.

While various chemiluminescent fluids, well known to those skilled in the art, can be used in connection with the present invention, the first chemiluminescent fluid is here provided as an oxalent. The oxalent components used in the present invention are standard in the chemiluminescent industry; as, for example, the oxalent ester present as a solution in the selected propolyene glycol vihydrocardyl ethyl solvent. The oxalent may include the solvent and the fluorescent or just the solvent. The second and third chemiluminescent fluids 42 and 42*a* which are contained within the ampules 36 and 36*a* respectively comprise the activator. The activator is capable of providing the desired chemiluminescent effect when combined with the oxalent in a manner well known in the prior art and may include any of a number of well-known, readily, commercially available activators. As previously mentioned, the second and third chemiluminescent fluids 42 and 42*a* are sealed within second spaces or chambers 40 by means of the frangible membranes 38 and 38*a* respectively.

In using the beverage container of the present invention, the container, when properly sealed by the screw cap 26, can readily be transported by the user during the conduct of various activities such as jogging, bicycling, hiking and during travel. The beverage contained within the container, whether it be water or a soft drink can be accessed by the user by simply removing screw caps 26. At any appropriate time desired by the user, the chemiluminescent effect can be achieved by simply exerting an inward force on the outer wall 18 of outer body 16 at a location opposite the area of the second spaces that contain the second and third chemiluminescent fluids 42 and 42*a*. Frangible membranes 38 and 38*a* are so constructed and arranged as to be fractured by such inward forces to permit the fluids contained within the second spaces 40 to flow into the first space 32 that is defined between the inner and outer walls of the inner and outer plastic bodies. Once the membranes 38 and 38*a* have been fractured, mixing of the first and second chemiluminescent fluids can be accelerated by inverting or shaking the bottle so that the fluids are thoroughly intermixed by the action of the fluid deflector means or deflector protuberances 48. As the fluids intermix, a pleasing and very colorful luminescent effect occurs permitting the bottle to effectively "light up" with the pleasing chemiluminescent glow. As previously mentioned, this novel and unique glow effect can be accomplished by the user of the beverage container at any place and at any time that may be desired to display the unique characteristics of the beverage container of the invention.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A beverage container comprising:

(a) an outer body having a yieldably deformable outer sidewall and a bottom wall, said outer sidewall terminating in a neck defining opening;

(b) a closure means connected to said neck for closing said opening;

(c) an inner body disposed within said outer body and cooperating therewith to define a space therebetween, said space having a first chemiluminescent fluid contained therewithin, said inner body having an inner sidewall; and (d) an ampule connected to one of said inner and outer sidewalls, said ampule having a second chemiluminescent fluid container therein and including a frangible membrane.

2. The beverage container defined in claim 1 in which said outer wall includes a plurality of vertically spaced ribs.

3. The beverage container defined in claim 1 in which said ampule is connected to said inner wall.

4. The beverage container defined in claim 2 further including a second ampule connected to said inner wall.

5. A beverage container comprising:

(a) an outer body having a yieldably deformable outer sidewall and a bottom wall, said outer sidewall terminating in a neck defining an opening;

(b) a closure means connected to said neck for closing said opening; and (c) an inner body disposed within said outer body and cooperating therewith to define a first space therebetween, said first space having a first chemiluminescent fluid contained therewithin, said inner body having:

(i) an inner sidewall having a shaped cavity formed therein defining a second space;

(ii) frangible closure means connected to said inner said wall for closing said second space;

(iii) a base wall connected to said inner wall; and (iv) a second chemiluiminescent fluid contained within said second space.

6. The beverage container defined in claim 5 in which said outer wall includes a plurality of vertically spaced ribs, each said rib having deflector means for deflecting said first chemiluminescent fluid.

7. The beverage container defined in claim 5 in which said inner sidewall has a second shaped cavity formed therein defining a third space and further includes a frangible closure means connected to said inner sidewall for closing said third space.

8. The beverage container defined in claim 7 further including a third chemiluminescent fluid contained within said third space.

9. The beverage container defined in claim 7 in which said first and second cavities comprise elongated, longitudinally extending cavities.

10. A beverage container comprising:

(a) an outer body having a yieldably deformable outer sidewall and a bottom wall, said outer sidewall terminating in a neck defining an opening and including a plurality of vertically spaced ribs, each said rib having a fluid deflecting protuberance;

(b) a closure cap removably connected to said neck to close said opening; and (c) an inner body disposed within said outer body and cooperating therewith to define a first space therebetween, said first space having a first chemiluminescent fluid contained therewithin, said inner body having:

(i) an inner sidewall having a first cavity formed therein defining a second space and a second cavity formed therein defining a third space;

(ii) first frangible closure means connected to said inner sidewall for closing said second space;

(iii) second frangible closure means connected to said inner sidewall for closing said third space;

(iv) a base wall connected to said inner wall; and (v) a second chemiluminescent fluid contained within said second space; and (vi) a third chemiluminescent fluid contained within said third space.

* * * * *